US005354211A

United States Patent [19]

Svette, Jr. et al.

[11] Patent Number: 5,354,211

[45] Date of Patent: Oct. 11, 1994

[54] ALIGNMENT OVERLAY FOR CONNECTOR HOUSING BLOCK

[75] Inventors: Joseph A. Svette, Jr., Newton Falls; Jeffrey A. Reeves, Cortland; Richard L. Kidd, Stow; Thomas M. Jackson, Canfield, all of Ohio

[73] Assignee: General Motors Corporation, Detroit, Mich.

[21] Appl. No.: 122,675

[22] Filed: Sep. 17, 1993

[51] Int. Cl.[5] ..... H01R 13/629

[52] U.S. Cl. ..... 439/381; 439/620; 439/689

[58] Field of Search ..... 439/381, 689, 686, 621, 439/620

[56] References Cited

U.S. PATENT DOCUMENTS

| | | | |
|---|---|---|---|
| 4,081,779 | 3/1978 | Ranzanigo | 337/198 |
| 4,622,444 | 11/1986 | Kandatsu et al. | 200/303 |
| 4,709,468 | 12/1987 | Wilson | 437/209 |
| 4,754,247 | 6/1988 | Raymont et al. | 335/202 |
| 4,861,286 | 8/1989 | Fosnaugh | 439/651 |
| 4,890,157 | 12/1989 | Wilson | 357/80 |

*Primary Examiner*—Gary F. Paumen
*Attorney, Agent, or Firm*—William A. Schuetz

[57] ABSTRACT

An electrically insulated connector housing has a cable receiving end and a mating end and a plurality of spaced cavities extending longitudinally therethrough for receiving terminals crimped onto electrical cables which are positioned within the cavities. The connector assembly also includes an alignment overlay overlying the mating end of the connector housing and which is adhesively secured thereto. The overlay has openings therethrough which are arranged in a plurality of predetermined patterns and which are aligned with certain ones of the terminal cavities in the housing. The housing block has projections extending from the mating end at certain locations and the alignment overlay has notches at certain locations for receiving the projections to ensure that the overlay can only be adhesively secured to the housing if properly oriented relative to the housing block. A plurality of electrical devices for connection with the terminals in the connector housing having projecting terminals arranged in a pattern which can only be inserted through a predetermined pattern opening in the alignment overlay and mated to the proper terminals in the block housing so that the alignment overlay prevents the electrical devices from being misconnected to the housing block.

4 Claims, 2 Drawing Sheets

ALIGNMENT OVERLAY FOR CONNECTOR HOUSING BLOCK

The present invention relates to an electrical connector assembly, and, more particularly, to an electrical connector assembly having a multi-cavity connector housing block, a plurality of electrical devices connected to terminals carried in the cavities of the housing block and an alignment overlay adhesively attached to the block to ensure that the electrical devices are properly oriented and attached to the proper terminals in the housing block.

It is common in automotive electrical systems to provide multi-cavity connector housings or blocks for housing a plurality of terminals connected to cables and to which electrical devices, such as relays, fuses, etc. can be connected. These housings can be universal or common to many different car models so as to accommodate different numbers of electrical devices, such as relays and fuses. That is, in some instances, all of the terminal cavities would have a terminal therein for connection to an electrical device and in other models or applications, only some of the cavities would have terminals therein for mating with electrical devices.

However, a problem can arise when connecting electrical devices having multiple terminals or prongs in that they can be rotated 180° and misconnected to the housing block. This can be easily done in the field or in service when such devices have to be replaced and then new devices misplugged or misconnected to the connector block.

The present invention allows both the use of a universal connector housing or block and prevents the electrical devices from being misconnected to the connector housing. In accordance with the provisions of the present invention, an alignment overlay overlies a mating end of the connector housing block and is adhesively secured to the block. The alignment overlay has openings therethrough which are arranged in a plurality of predetermined patterns and which are aligned to certain ones of the terminal cavities in the connector housing. The alignment overlay covers certain of the terminal cavities and uncovers others and the overlay can have lettered indicia thereon so that the electrical devices, especially relays, can only be connected to the connector housing with its prongs in the proper orientation. This thus prevents the electrical devices from being misconnected to the housing block.

In addition, the alignment overlay has notches at its corners and/or sides which receive projections on the connector housing so that the alignment overlay itself can only be adhesively secured to the connector housing block if properly oriented to the housing block.

Preferably, the alignment overlay would also have peel strips on its side which can be peeled away to expose an adhesive so as to enable it to be readily attached to the connector housing block.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
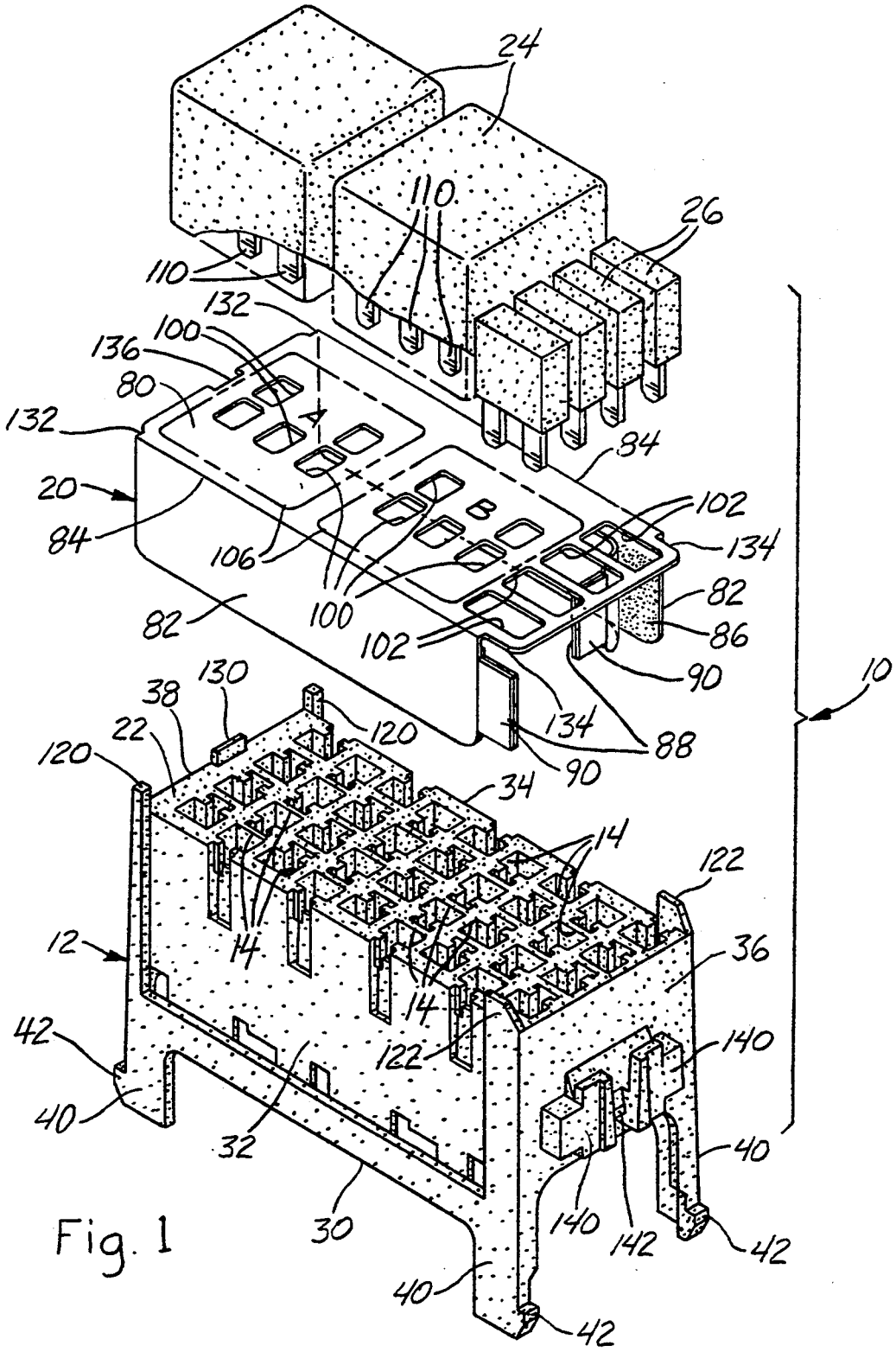
FIG. 1 is an exploded perspective view of the electrical connector assembly in accordance with the preferred embodiment of the present invention.
Figure 2:
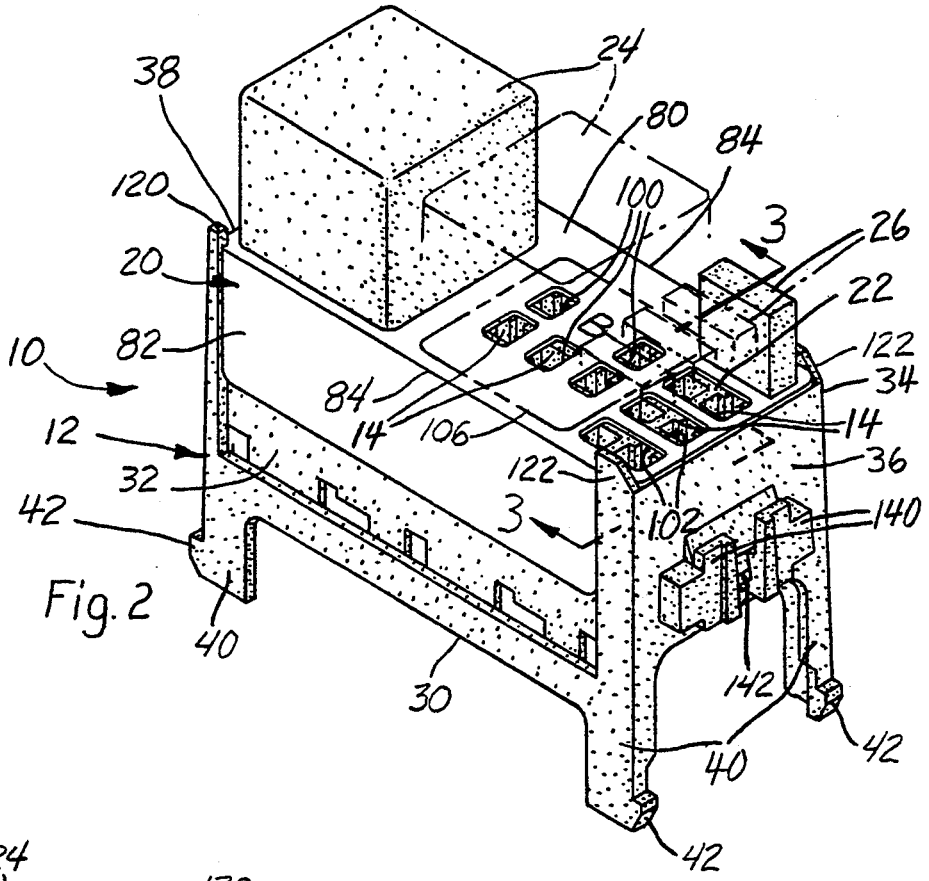
FIG. 2 is a perspective view of the electrical connector assembly of the present invention and showing the various parts connected.

Referring to the drawings, an electrical connector assembly 10 is thereshown. The electrical connector assembly 10 comprises, in general, a connector housing or block 12 having a plurality of cavities 14 extending longitudinally therethrough for housing a plurality of terminals 16 within the connector housing 12, and an alignment overlay 20 which overlies an end face 22 of the housing 12, is adhesively secured to the housing 12 and which has indicia and openings arranged in a predetermined pattern to provide a footprint for electrical devices 24, 26 to be connected to the connector housing 12 and mated with the terminals 16.

The connector housing 12 is molded from a suitable plastic or dielectric material and is generally rectangular in shape. The connector housing 12 has a cable receiving end face 30 as well as a mating end surface or face 22. The connector housing 12 has spaced parallel sides 32, 34 and spaced ends 36, 38. The connector housing 12 at each of its four corners has a downwardly extending leg 40 provided with a barb or ramp 42 to enable the connector housing 12 to be snap fittingly connected to an apertured panel or support in an automotive vehicle.

Figure 3:
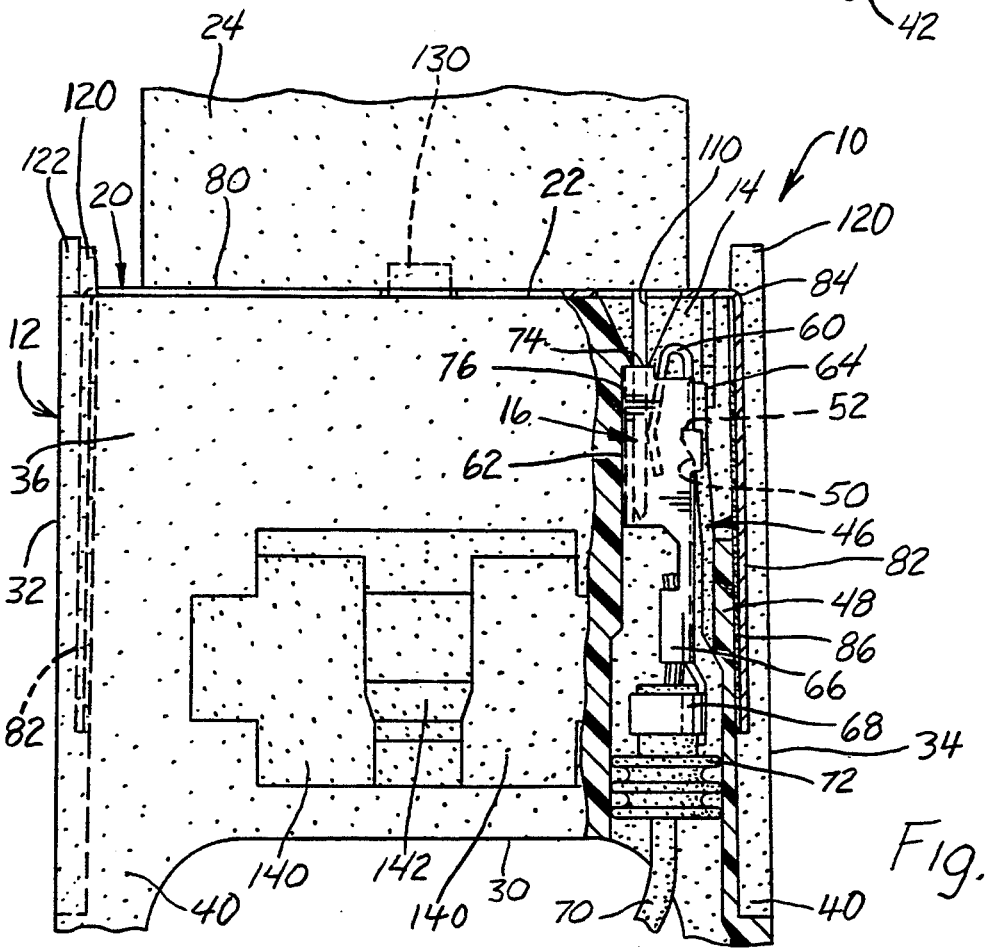
FIG. 3 is an enlarged, fragmentary side elevational view, with parts shown in section, of the electrical connector assembly shown in FIG. 2.

A connector housing 12 also has a plurality of cavities 14 extending longitudinally therethrough from the cable receiving end 30 to the mating end 22. As shown in FIG. 3, the cavities 14 are all of an identical cross sectional shape and each is provided with an integral deflectable or flexible arm 46 in one of its side walls 48. The flexible arm 46 includes a tapered ramp 50 which terminates in a shoulder 52 extending normal to the longitudinal extent of a cavity 14, and for a reason to be presently described.

The terminals 16 could be of any suitable or conventional construction, but preferably are conventional rectangular or box shaped terminals having a reversely bent deflectable engagement arm 60 which is biased toward a flat top wall 62 of the terminal. The terminal 16 at its bottom wall 64 has an opening therein for receiving the ramp 50 of the flexible finger 46. The terminal 16 also has crimping wings 66, 68 which are crimped onto wire and insulating portions of an electrical conductor 70 and in a conventional manner. In the embodiment shown, the insulated portion of the conductor 70 would also carry a seal 72.

The terminals 16 are connected to the connector housing 12 by inserting the same into the cavities 14 from the cable receiving side or end 30. Each of the terminals 16 at its bottom side engages the flexible arm 46 to cam the arm 46 in a clockwise direction, as viewed in FIG. 3, until it is positioned adjacent the opening in the bottom wall 64 adjacent the ramp 50 whereupon it snaps into the opening. The terminal 16 at its upper end 74 engages a shoulder 76 on the connector housing 12 which prevents further insertion of the terminal 16 into the cavity 14. The shoulder 52 of the ramp prevents removal of the terminal downwardly, as viewed in FIG.

3, and thus positions the terminal within the connector housing 12.

The alignment overlay 20, as best shown in FIG. 1, is stamped from a suitable thin planar material, preferably 0.25 millimeter Nomex material made by the DuPont company. It is stamped and bent to the position shown in FIG. 1. The alignment overlay 20 has a top, flat surface 80 and a pair of parallel sides 82 which are folded downwardly from the top 80 along fold lines 84. The sides 82 along their back sides are provided with an adhesive 86 which is covered prior to use with a peeling strip 88. The peel strip 88 extends forwardly of the adhesive 86 to provide a tab 90. The overlay 20 is secured to the connector housing 12 by grasping the tab and peeling off the two peel strips 88 and then positioning the overlay over the mating end surface 22 and pressing the sides 82 thereof against the sides 32, 34 of the connector housing 12. This secures the overlay to the connector housing 12.

The alignment overlay 20 at its top is provided with openings therethrough which are arranged in a plurality of predetermined patterns and which are aligned with certain ones of the terminal cavities 14. As shown in FIG. 1, the overlay 20 is provided with two groups of five openings 100 in a pattern and a series of rectangular other openings 102. In addition indicia indicated by the letters A and B and surrounded by a boxed lines 106 are provided. The openings 100 overlie certain ones of the cavities 14 and other portions of the top 80 of the overlay 20 covers cavities not being used. The groups of five openings 100 are for receiving electrical devices 24 in the form of relays having five male blades or prongs 110. These relays are connected to the terminals 16 in the terminal block by plugging the same through the opening 100 in the areas designated A and B. Openings 102 are for use with the fuses 26.

By using the alignment overlay 20, the multi-prong relays 24 can only be connected to the connector housing 12 by properly inserting the same into the proper cavities. Thus the relays 24 cannot be connected by rotating the same 180° from what is shown in FIG. 1 because the metal prong in the three prong set will have no opening to pass through. This will afford manufacturing and aftermarket repair people the ability to easily insert the electrical devices into the connector housing 12 with their proper or correct orientation.

Also, the alignment overlay 20 itself cannot be misconnected to the connector housing 12. As best shown in FIG. 1, the connector housing 12 at two of its corners has an upwardly extending, square shape projection 120 and at its other two corners has an upwardly extending projection 122 which is rectangular in shape. In addition, the connector housing 12 adjacent its end 38 and midway between the projections 120 at the corners has an upwardly extending tab 130. The alignment overlay 20 at its top has complementary shaped recesses or notches 132, 134 for receiving the projections 120, 122 and also has a notch or recess 136 which receives the upwardly extending tap 130. It is thus necessary to properly orient the alignment overlay to the top or mating end surface 22 of the connector housing 12 in order for it to be connected thereto. It would not fit if an attempt is made to adhesively secure the same thereto when it is rotated 180°.

In addition, the connector housing at each of its ends 36, 38 has a pair of guides 140 and an intermediate ramp 142. The ramp 142 is adapted to be connected to a latch finger (not shown) of a cover (not shown) for covering the entire connector housing 12.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed is defined as follows:

1. In combination, an electrically insulated connector housing block having a cable receiving end and a mating end, said housing block having a plurality of spaced terminal cavities extending longitudinally there through from said cable receiving end to said mating end, a plurality of electrical terminals crimped onto electrical cables and which are positioned within said cavities adjacent said mating end of said housing block, an alignment overlay overlying said mating end of said block and which is adhesively secured to said block, said overlay having openings therethrough which are arranged in a plurality of predetermined patterns and which are aligned with certain ones of said terminal cavities, said housing block having projections extending from said mating end thereof at certain locations and said alignment overlay having notches at certain locations for receiving said projections to insure that said overlay can only be adhesively secured to said housing block if properly oriented relative to said housing block, a plurality of electrical devices for connection with terminals in said block housing, said electrical devices having projecting terminals arranged in a pattern which can only be inserted through a predetermined pattern of openings in said alignment overlay and mated to proper terminals in said block housing whereby said alignment overlay prevents said electrical devices from being misconnected to said housing block.

2. In combination, an electrically insulated connector housing block having a cable receiving end and a mating end terminating in a planar end face, said housing block having a plurality of spaced terminal cavities extending longitudinally therethrough from said cable receiving end to said mating end, a plurality of electrical terminals crimped onto electrical cables and which are positioned within said cavities adjacent said mating end of said housing block, a planar alignment overlay having a top overlying said end face of said mating end of said housing block and a pair of sides folded normal to the top, said sides having an adhesive applied to inner sides thereof which are initially covered by peel strips, said overlay being secured to said housing block by peeling off said peel strips and pressing said sides against respective adjacently located sides of said housing block, said overlay having openings therethrough which are arranged in a plurality of predetermined patterns and which are aligned with certain ones of said terminal cavities, said housing block at certain locations, including at corners thereof, having projections extending upward from said mating end thereof and said alignment overlay having notches at locations on its top side corresponding to said projections on said housing block for receiving said projections to insure that said overlay can only be adhesively secured to said housing block if properly oriented relative to said housing block, a plurality of electrical devices for connection with terminals in said block housing, said electrical devices having projecting terminals arranged in a pattern which can only be inserted through a predetermined pattern of openings in said alignment overlay and mated to said terminals in said block housing whereby said alignment overlay prevents said electrical devices from being misconnected to said housing block.

3. An alignment overlay, as defined in claim 2, and wherein said alignment overlay includes indicia thereon to indicate where certain electrical devices should be connected so that said devices are connected to their proper terminals in said housing.

4. An alignment overlay, as defined in claim 3, and wherein said electrical devices include both electrical fuses and other electrical devices, such as relays.

* * * * *